US005301771A

United States Patent [19]

Sishtla et al.

[11] Patent Number: 5,301,771

[45] Date of Patent: Apr. 12, 1994

[54] OIL CHANNELING IN A CENTRIFUGAL COMPRESSOR TRANSMISSION

[75] Inventors: Vishnu M. Sishtla, E. Syracuse; Thomas M. Zinsmeyer, Pennellville, both of N.Y.

[73] Assignee: Carrier Corporation, Syracuse, N.Y.

[21] Appl. No.: 748,734

[22] Filed: Aug. 22, 1991

[51] Int. Cl.[5] ..... F01M 11/00

[52] U.S. Cl. ..... 184/6.16; 184/6.12; 184/6.27; 384/144; 384/488

[58] Field of Search ..... 184/6.12, 11.1, 6.16, 184/13.1, 6.27; 74/467; 384/144, 488, 130, 403

[56] References Cited

U.S. PATENT DOCUMENTS

| | | | |
|---|---|---|---|
| 1,561,745 | 11/1925 | Redfield | 184/11.1 |
| 2,487,350 | 11/1949 | Markland | 184/11.1 |
| 2,505,595 | 4/1950 | Warren | 184/6.16 |
| 2,762,349 | 9/1956 | Malcolm | 184/6.16 |
| 2,908,176 | 10/1959 | Brueggeman | 384/130 |
| 3,195,682 | 7/1965 | Reneerkens | 184/6.12 |
| 3,447,843 | 6/1969 | Shipman | 384/144 |
| 3,942,849 | 3/1976 | Doyle et al. | 384/144 |
| 4,274,298 | 6/1981 | Ostrander | 184/6.12 |
| 4,329,887 | 5/1982 | Kawamoto | 184/6.12 |
| 4,712,442 | 12/1987 | Baika et al. | 184/6.12 |
| 4,952,077 | 8/1990 | Kurt | 184/11.1 |
| 5,035,155 | 7/1991 | Robledo | 184/6.12 |

FOREIGN PATENT DOCUMENTS

| | | | |
|---|---|---|---|
| 0146645 | 8/1950 | Australia | 384/130 |

*Primary Examiner*—Richard R. Cole
*Assistant Examiner*—Alan B. Cariaso

[57] ABSTRACT

In the transmission of a centrifugal compressor, where a gear is located adjacent to a lubricated bearing, a barrier is provided between the bearing and the gear to restrain the flow of oil to the gear and thereby reduce the pumping and windage losses that would otherwise occur. An oil port is made to communicate with the internal area of the barrier to thereby provide drainage of the accumulated oil to a sump.

11 Claims, 6 Drawing Sheets

OIL CHANNELING IN A CENTRIFUGAL COMPRESSOR TRANSMISSION

BACKGROUND OF THE INVENTION

This invention relates generally to centrifugal compressors and, more particularly, to an improved lubrication method and apparatus therefor.

Hermetic centrifugal refrigeration compressors generally use an electric motor to drive the impeller through a geared up transmission. In such a compressor, the transmission is typically vented to a source of low pressure refrigerant within the system to minimize the outward migration of oil through the shaft seals. It has been recognized that during this venting process, in addition to the refrigerant gas passing out of the transmission, some of the oil in the form of droplets or mist may become entrained within the refrigerant gas and also pass out from the transmission. This is not been a particular problem.

With the more recent use of higher pressure and higher density refrigerants, such as R-22, the problem of oil carry over has become an issue. That is, because of the higher pressure refrigerant, it is necessary to operate the gears at higher speeds. This is in turn increases the turbulence and the oil mist generation within the transmission. Further, the larger pressure differentials tend to promote higher vent gas flow rates and therefore increased carry over.

In addition to the refrigerant higher pressures, the higher densities also tend to exasperate the problem. That is, the increased densities tend to keep the oil droplets in suspension longer and makes separation more difficult. In addition, the mechanical losses from oil separation mechanisms are higher due to increased density.

Considering now the result of oil carry over, when the oil entrained refrigerant from the transmission is vented to the compressor inlet, it passes through the compressor and is discharged into the condenser, where it may tend to coat the heat exchanger surface to thereby decrease the efficiency thereof. Some of the oil is then passed on to the cooler where the same phenomenon occurs. Thus, it will be recognized that high oil carry over rates tend to result in poor heat exchanger performance. More over, as the oil supply in the sump is diminished because of this phenomenon, there may no longer be sufficient amount of oil to insure that all of the moving parts that require lubrication are in fact receiving adequate supplies of oil.

The oil carry over problem has been addressed in two different ways. First, the most common approach is to use a mesh type oil separator in the vent line to cause oil droplets to coalesce and drain back into the transmission. A second method uses a series of hollow rotating tubes to centrifuge out the unwanted oil mist component of the vent flow. Neither of these methods, by themselves, are found to be sufficient for containing oil in a centrifugal compressor using high pressure, high density refrigerant such as R-22.

In addition to the loss of oil from the transmission as occasioned by the high speed rotation of the gear, there are also mechanical losses brought about by the oil from the bearings being transferred into the gear mesh and onto the gear face. That is, oil on the gear causes windage losses as well as oil pumping losses, since the gear mesh then acts as a pump. These, in turn, increase the load on the bearings and may reduce the life thereof.

It is therefore an objection of the present invention to provide an improved lubrication system for a centrifugal compressor.

Another object of the present invention is the provision in a centrifugal compressor for reducing mechanical losses brought about by oil being disposed on the gears Yet another object of the present invention is the provision in a centrifugal compressor for reducing windage losses and oil pumping losses in the transmission.

Another object of the invention is to provide a mechanism by which the used oil is conveyed directly to the sump without being "caught up" in the turbulent environment within the transmission.

Still another object of the present invention is the provision in a centrifugal compressor for reducing the load on the bearings.

Yet another object of the present invention is the provision in a centrifugal compressor for a lubrication system which is economical and practical in operation.

These objects and other features and advantages become more readily apparent upon reference to the following description when taken in conjunction with the appended drawings.

SUMMARY OF THE INVENTION

Briefly, in accordance with one aspect of the invention, an oil containment barrier is provided around a bearing so as to impede the outward flow of oil onto the gear(s) of the transmission into and into the transmission chamber in general. In this way, the bearings may be lubricated without allowing the oil to subsequently flow to the gear(s) where it would cause mechanical losses and/or add to the oil mist within the transmission.

By yet another aspect of the invention, provision is made to drain oil away from the barrier and into the sump such that there will be no substantial accumulation of oil within the barrier. This is accomplished by the way of a series of ports which allow the oil to drain to the sump by way of gravity. Passages are well protected from effects of swirling gas, and oil is isolated from the turbulence.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
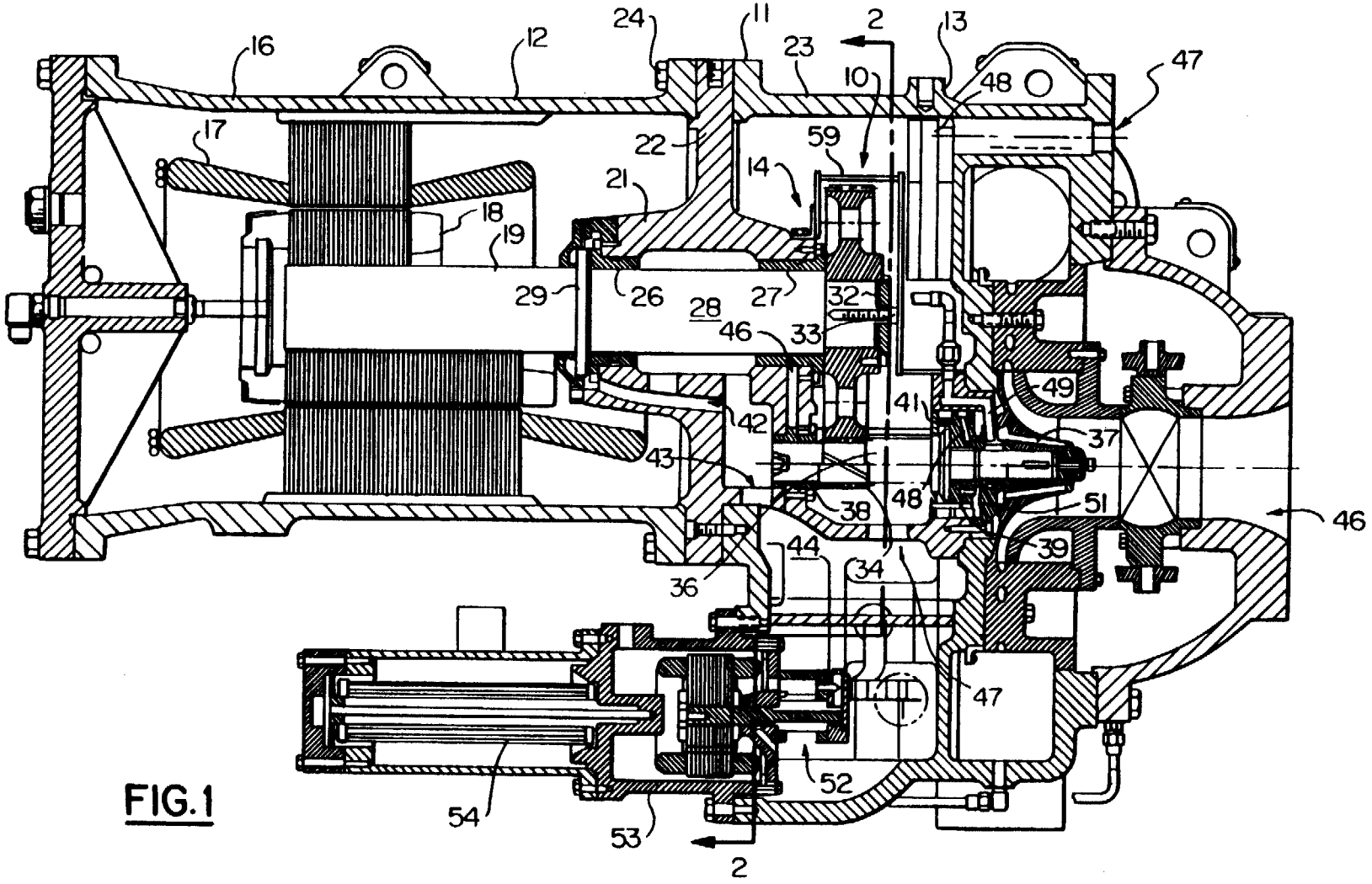
FIG. 1 is a longitudinal cross sectional view of a centrifugal compressor having the present invention embodied therein.

Referring now to FIG. 1, the invention is shown generally at 10 as embodied in a centrifugal compressor system 11 having an electric motor 12 at its one end and a centrifugal compressor 13 at its other end, with the two being interconnected by a transmission 14. The motor 12 includes an outer casing 16 with a stator coil 17 disposed around its inner circumference. The rotor 18 is then rotatably disposed within the stator winding 17 by way of a rotor shaft 19 which is overhung from, and supported by, the transmission 14.

The transmission 14 includes a transmission assembly 21 having a radially extending annular flange 22 which is secured between the motor casing 16 and the compressor casing 23 by plurality of bolts 24. Rotatably mounted within the transmission assembly 21, by way of a pair of axially spaced bearings 26 and 27 is a transmission shaft 28 which is preferably integrally formed as an extension of the motor shaft 19. The collar 29, which is attached or installed by shrink fit, is provided to transmit the thrust forces from the shaft 28 to the thrust bearing portion of the bearing 26. The end of shaft 28 extends beyond the transmission assembly 21 where a drive gear 31 is attached by way of a retaining plate 32 and a bolt 33.

The drive gear 31 engages a driven gear 34 which in turn drives a high speed shaft 36 for directly driving the compressor impeller 37. Typical speeds for the respective shafts are 3550 rpm for the transmission shaft 28 and 16,000 rpm for the high speed driven shaft 36. The high speed shaft 36 is supported by bearings, one of which is shown at 38 and the other at 39. A thrust bearing 40, which is engaged by a collar 41 on the shaft 36, is provided to counteract the axial thrust that is developed by the impeller 37.

Lubrication of the bearings occurs as follows. Oil is provided to the bearing 26 and 27 by way of the transmission assembly 21. Oil from the bearing 26 flows through the passage 42 and then through the opening 43 to the sump 44. From an oil feed annulus surrounding bearing 27 supply oil flows into passage 46 to lubricate the bearing 38. The oil then runs from the left side of the bearing 38 through the opening 43 to enter the sump 44. Similarly, it flows from the right side of the bearing 38 through the opening 47 into the sump 44.

Referring now to the bearing 39 at the other end of the high speed shaft 36, an oil feed passage 48 is provided as a conduit for oil flowing radially inwardly to the bearing surfaces. Oil discharge from the bearing 39, on the right side, flows toward slinger 49 and is slung outwardly into cavity 51. Oil discharge from the bearing 39, on the left side, flows toward thrust bearing 40, where it mixes with thrust bearing oil and is discharged into cavity 101. As the oil accumulates in the sump 44, it is drawn into the inlet 52 of the oil pump 53, which functions to pump it through a filter 54 and then to the system components for lubrication thereof.

In order to limit the migration of oil from the transmission 14 by way of the shaft seals, the transmission 14 is vented to a source of low pressure refrigerant (i.e. to the compressor inlet 46) by way of a transmission vent opening 47. An oil separator or demister 48 is provided to recover a certain amount of entrained oil before the refrigerant passes into the opening 47. Such an oil separator, however, will not, by itself, suffice if the amount of oil that is so entrained is excessive, such as tends to be the case with high speed, high pressure machines such as those used with R-22 refrigerant.

It is recognized that a certain amount of oil is going to be thrown radially outwardly by the drive gear 31. In order to prevent that oil from creating a mist and being entrained within the refrigerant surrounding the transmission 14, a gear shroud 59 is provided in close surrounding relationship to the gear 31. The shroud 59 functions to direct the oil that is collected by the gear shroud 59 in a downward direction toward the oil pump 53.

In addition to the desirability of limiting the amount of oil that is centrifuged radially outwardly by the drive gear 31, it is also desirable to limit the amount of oil that flows over the face of the drive gear 31 and eventually to the mesh between the drive gear 31 and the driven gear 34. In this regard, it is recognized that a significant amount of heat is generated by the interaction of the two gears during operation, and that the introduction of oil at the mesh is desirable to transfer that heat away from the mesh. This is accomplished in the present case by introducing a flow of oil on the leaving side of the mesh between the two gears. A stripper is then provided in the near vicinity to strip the oil free from the drive gear 31 and prevent it from being carried around as the gear continues to rotate away from the mesh point. The only oil that remains then is a thin film which performs the necessary lubrication function at the entering side of the mesh point between the gears. The remaining oil is stripped free to drop down into the oil sump 44.

Another source of oil that is available to the drive gear 31, however, is that which is used to lubricate the journal bearing 27. That is, at the interface of the journal bearing 27 and the drive gear 31, there is tendency for the oil to flow over on to the face of the drive gear 31 and then be propelled across its face and finally enter the mesh between the drive gear 31 and the driven gear 34. Similarly, oil from the journal bearing 38 tends to flow onto the high speed gear 34 and enter the gear mesh. In each case, this excessive oil at the gear mesh tends to introduce oil pumping and windage losses to the system. The oil pumping that occurs at the mesh also tends to add additional loading on the bearings 27 and 38.

In addition to the oil that is introduced to the gears by way of the journal bearings 27 and 38, the applicants have found that the oil discharged from thrust bearing 40 impinges on the face of gears 31 and 34 and enters the mesh. Additional pumping and windage losses are therefore experienced in this manner. In order to reduce these losses, the applicants have provided structural barriers to limit the amount of oil that migrates from the bearings toward the gears. Structural barriers are shown generally at 61, 62 and 63 in FIG. 2 and are shown in greater detail in FIGS. 3-13.

The oil barrier 61 as shown in FIGS. 2-5 comprises a ring 64 having a cylindrical section 65 and a flange section 66. A cover plate 67 having holes 68 is attached to one end of the cylindrical section 65 by appropriate fasteners that register with the holes 69 in the cylindrical section 65. These fasteners also function to secure the ring 64 to the transmission assembly 21 as will be seen in FIG. 2. The barrier structure 61, which is U-shaped in axial cross section, provides a barrier to prevent the migration of oil from the bearing 27 to the drive gear 31, with the cylindrical section 65 tending to provide a barrier against radial movement of the oil and the cover 67 tending to provide a barrier against the axial movement of oil to the drive gear 31.

Figure 4:
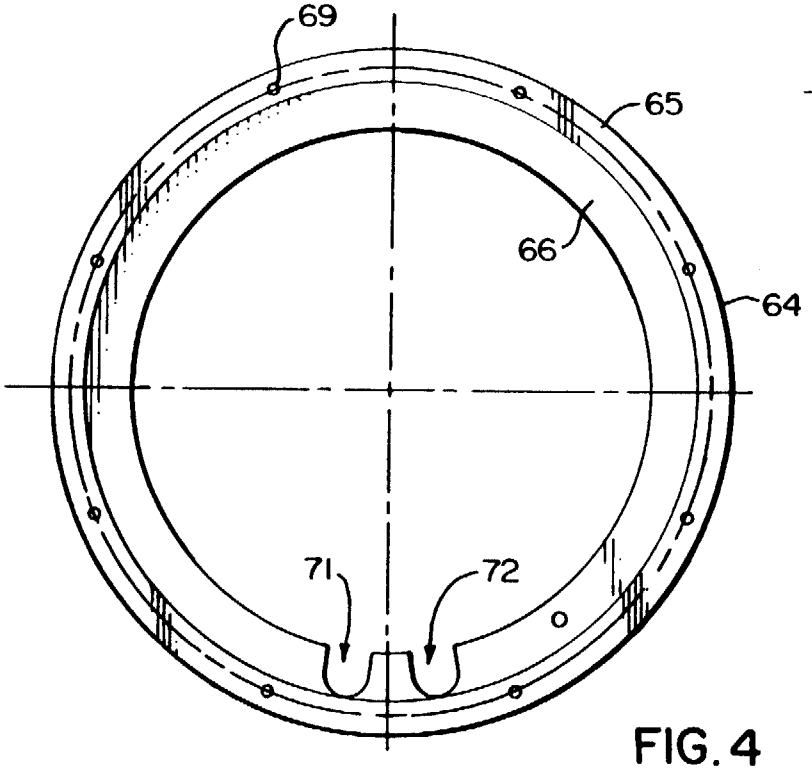
FIG. 4 is a front view thereof.
Figure 3:
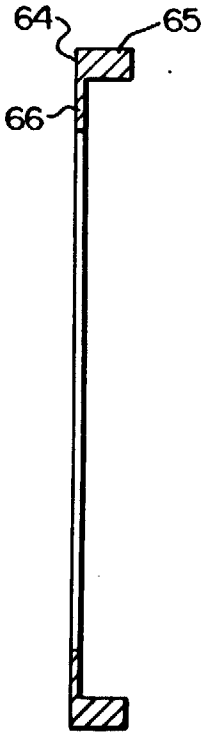
FIG. 3 is a cross sectional view of an oil containment structure in accordance with one embodiment of the invention.

As the barrier 61 restricts the flow of oil to the drive gear 31, the oil will tend to accumulate within the barrier 61 and flow to the bottom section thereof. Provision is therefore made to drain this oil from the barrier 61 by way of a pair of passages in a transmission assembly 21, one of which is shown at 70 in FIG. 2. To accommodate this flow, there are a pair of openings 71 and 72 in the bottom portion of the plate section 66 as shown in FIG. 4. That is, the openings 71 and 72 register with the passages 70 of the transmission assembly 21. Thus, the oil from the general bearing 27 is caught by the barrier 61 and caused to flow through the passages 70 and the opening 43 to the sump 44 below.

Figure 2:
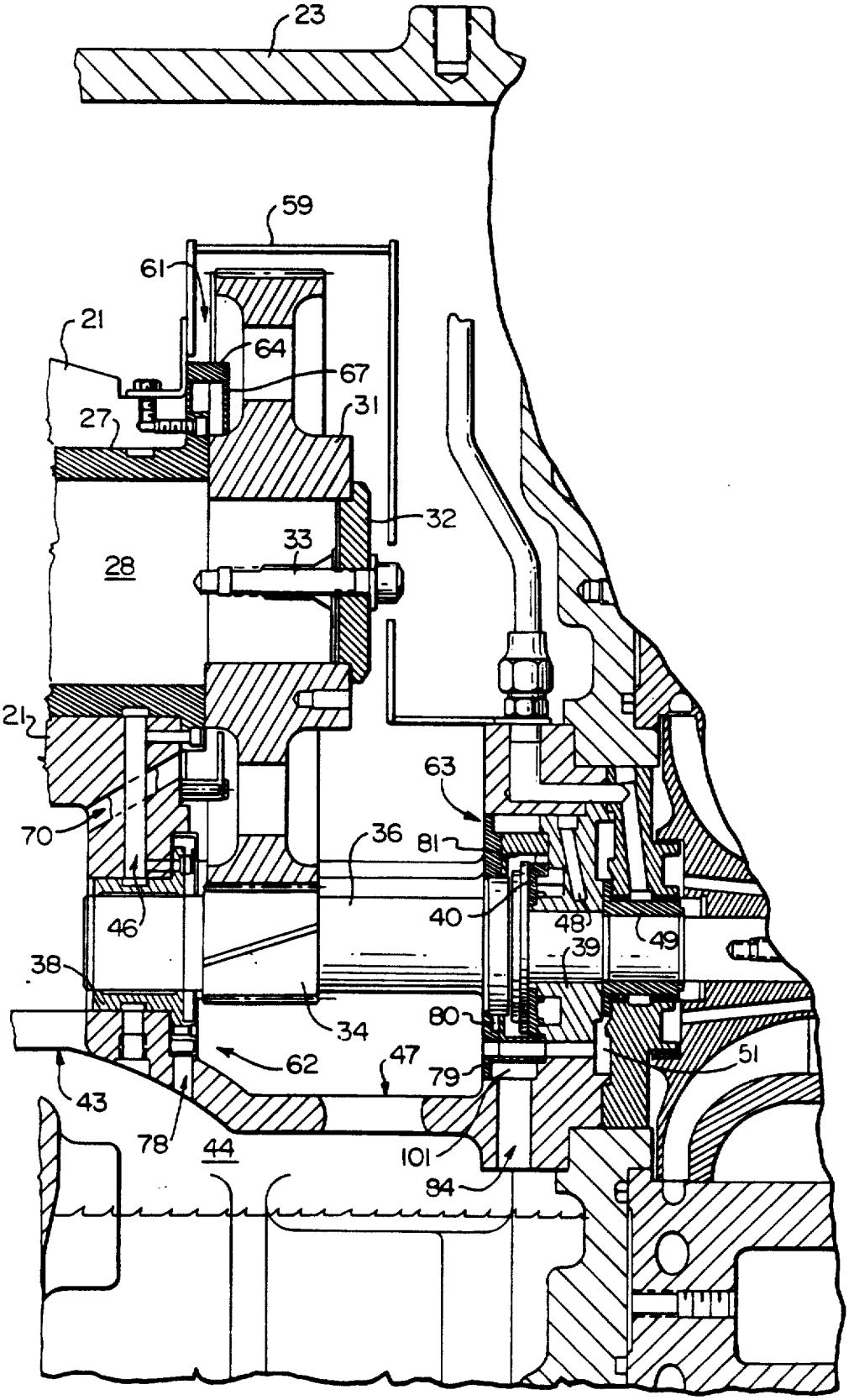
FIG. 2 is an enlarged partial view thereof showing the oil containment structure of the present invention.
Figure 5:
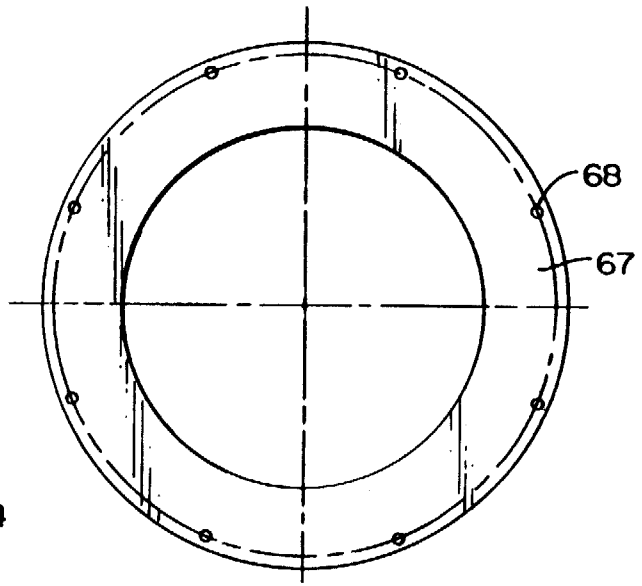
FIG. 5 is a front view of a cover portion thereof.
Figure 6:
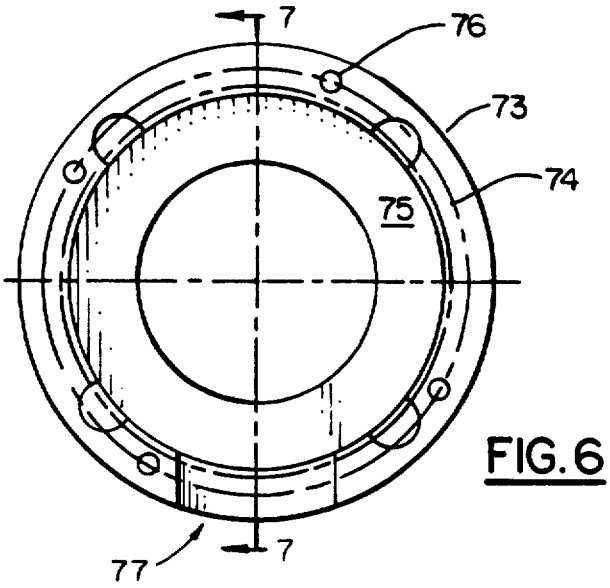
FIG. 6 is a front view of an oil containment structure in accordance with another embodiment of the invention.
Figure 7:
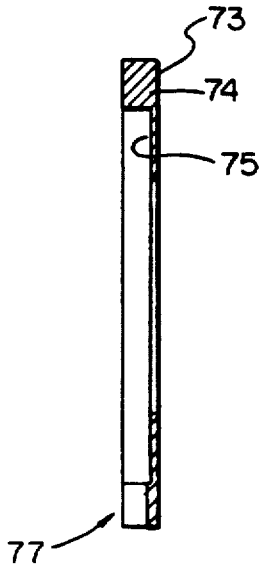
FIG. 7 is a cross sectional view thereof as seen along lines 7—7 in FIG. 6.
Figure 8:
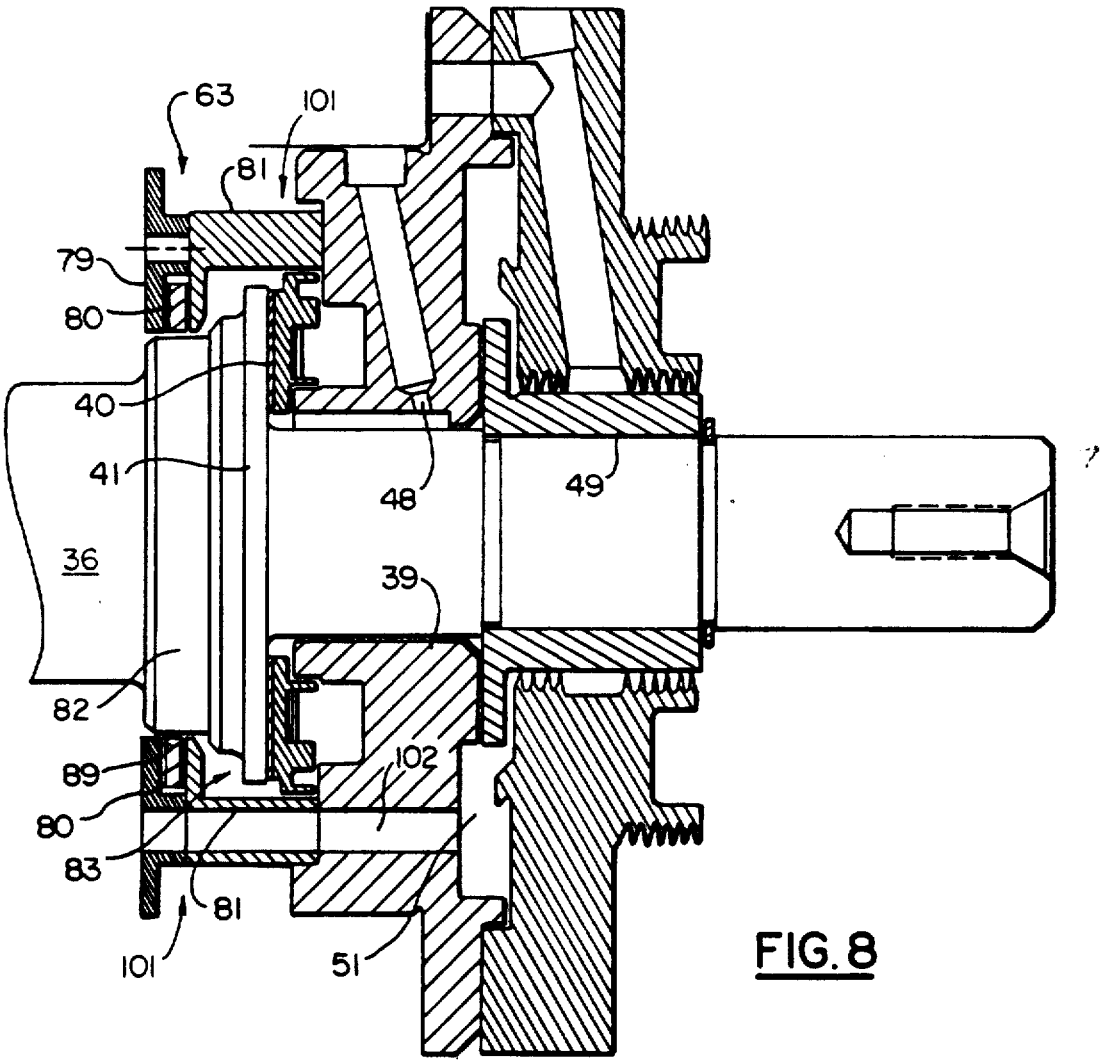
FIG. 8 is an enlarged cross sectional view of another embodiment of the present invention as incorporated with the thrust bearing.

The barrier 62, as shown in FIGS. 2, 6 and 7, performs a similar function to prevent the flow of oil between the journal bearing 38 and the high speed gear 34. The annulus 73 comprises a cylindrical section 74 and a plate section 75. The cylindrical section 73 includes a plurality of holes 76 for mounting the annulus 73 to the bearing 38 by appropriate fasteners. At the bottom portion of the annulus 73 there is a portion of the cylindrical section 74 removed to present a channel 77 through which oil may be drained from the annulus 73 to a passage 78 where it finally enters the sump 44. Thus, the oil that would otherwise flow from the bearing 38 to the high speed gear 34 is collected by the annulus 73 and caused to flow through the channel 77 and the passage 78 to enter the sump 44.

The barrier 63, is shown in FIG. 2 and in FIGS. 8-14. It comprises a retaining ring 79, a seal ring 80 and a spacer ring 81. As will be seen, the seal ring 80 is retained in surrounding relationship with the collar 82 of shaft 36 by way of the retaining ring 79 and spacer ring 81 disposed on either side thereof. The combination forms a cavity 83 surrounding the thrust bearing collar 41 with oil from cavity 83 being discharged into cavity 101. Oil from the cavity 101 is drained out through the passage 84 to the oil sump 44 as shown in FIG. 2.

Figure 10:
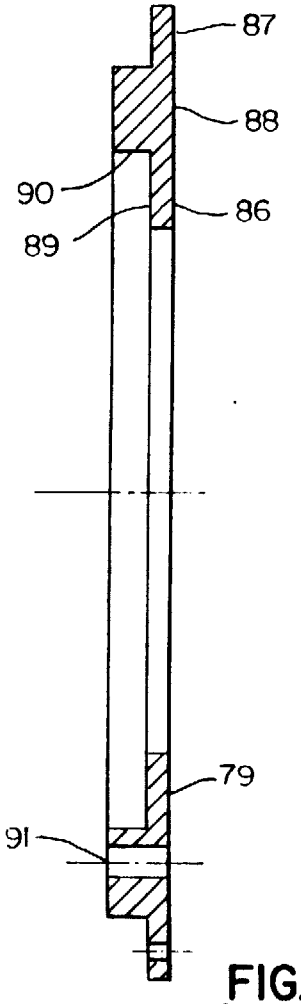
FIG. 10 is an axial cross sectional view thereof.
Figure 9:
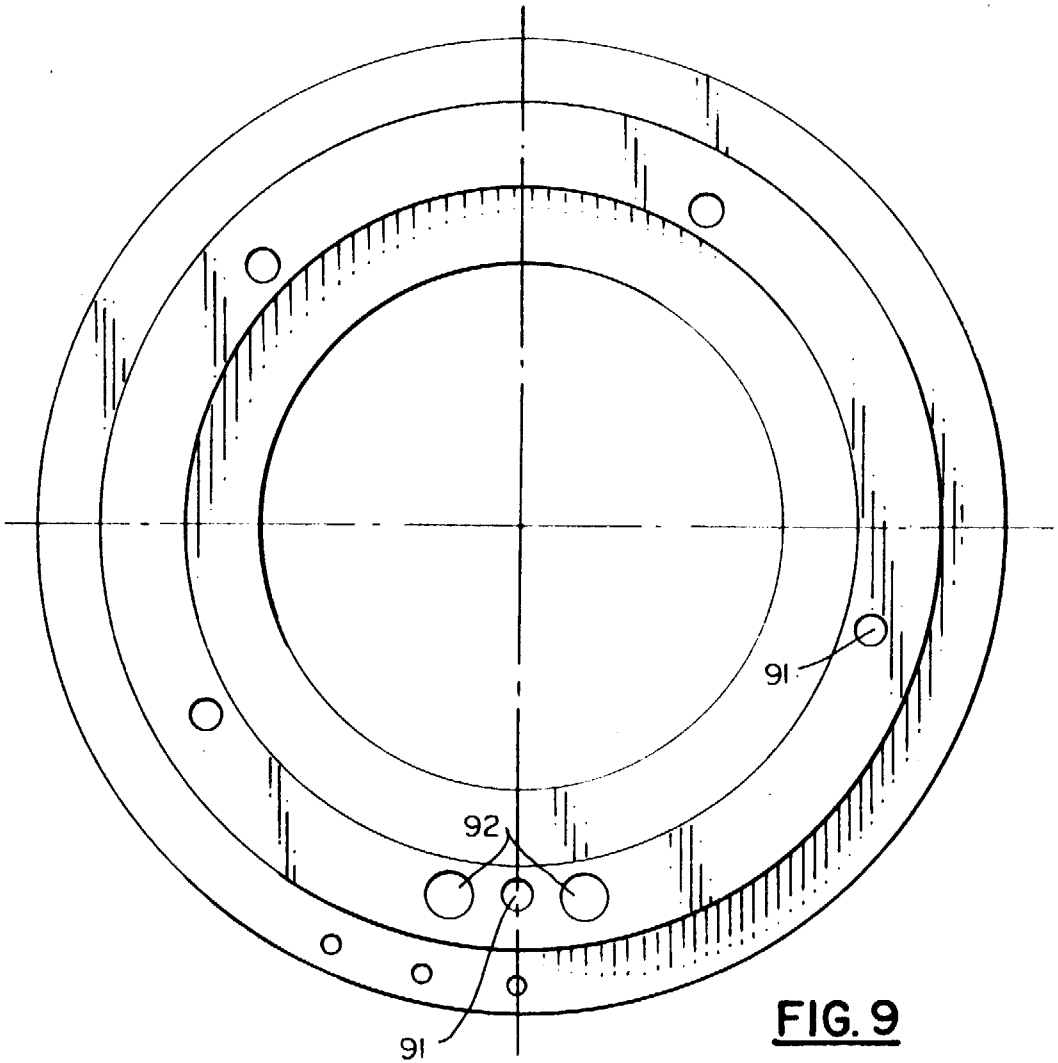
FIG. 9 is a front view of a retaining ring portion thereof.

Referring now to FIG. 9 and 10, the retaining ring is T-shaped in axial cross section and includes outer flange 87 and inner flange 86 to cooperatively define the open end surface 88. On the other side of the inner flange 86 is a radially extending, seal retaining surface 89 and an axially extending seal retaining surface 90. A plurality of holes 91 are provided around the circumference of the retaining ring for the insertion of bolts to secure the retaining ring 79 to the bearing 39. A pair of holes 92 are also provided near the bottom of the retaining ring 79 to vent the cavity 51, by way of the openings 102 in the bearing 39, to that area surrounding the transmission 14 such that oil can be drained from the cavity 51 without the occurrence of vapor locks.

Figure 11:
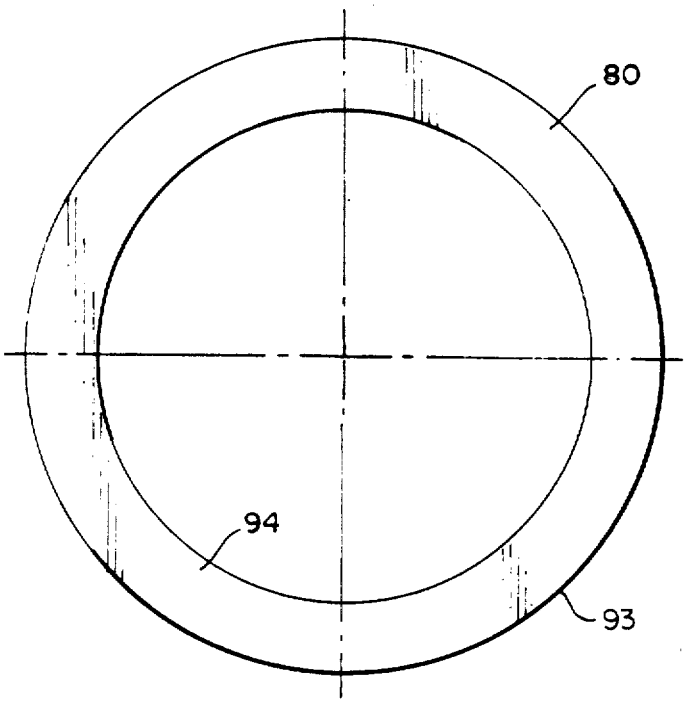
FIG. 11 is a front view of a seal ring portion thereof.
Figure 12:
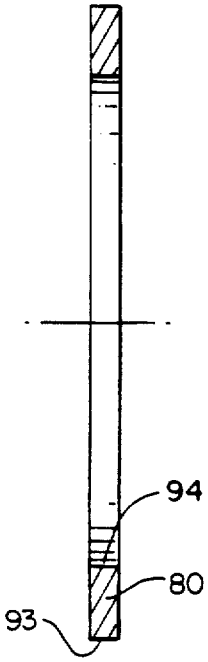
FIG. 12 is an axial cross sectional view thereof.

The seal ring 80, shown in FIGS. 11 and 12, is a simple bronze ring with an outer circumference 93 having a smaller diameter than the inner diameter of the axially extending seal retaining surface 90 of the retaining ring 79. Its inner circumference 94 is just slightly greater than that of the collar 82 such that when the seal ring 80 is installed over the collar 82, there is a sealing relationship therebetween to prevent the flow of oil out of the cavity 83.

Figure 13:
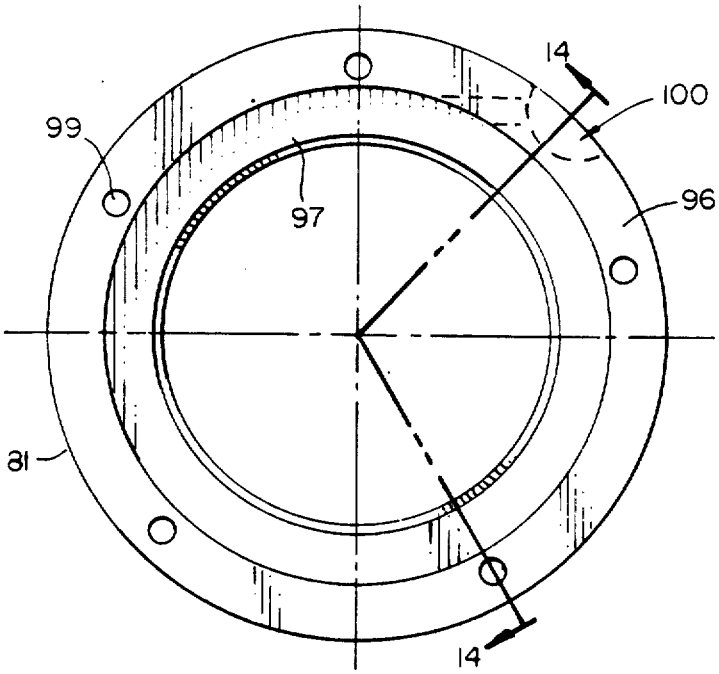
FIG. 13 is a front view of a spacer ring portion thereof.
Figure 14:
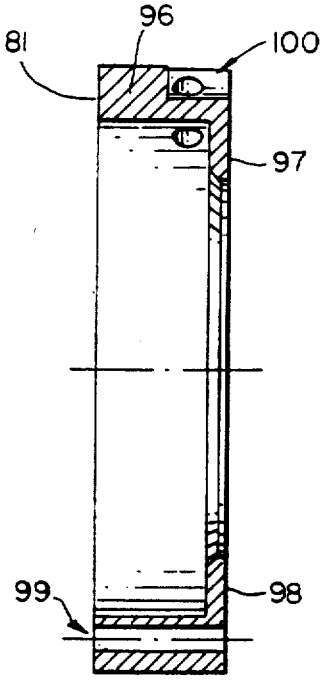
FIG. 14 is an axial cross sectional view thereof as seen along lines 14—14 of FIG. 13.

The spacer ring 81, which is held in place against the bearing 39 with the same bolts as the retaining rings 79, is shown in FIGS. 13 and 14 and comprises a ring having a cylindrical portion 96 and an inwardly extending flange 97. When installed, the outer surface 98 of the flange 97 engages the seal ring 80 and retains it in its axial position. A plurality of holes 99 are provided for receiving the bolts (not shown) for retaining the spacer ring 81 against the bearing 39. A semi-circular opening 100 is formed in the outer circumference of the spacer ring 81 as shown to provide a channel for fluidly communicating between the cavity 83 and anular cavity 101 which is drained by passage 84 (FIG. 2). That is, oil passes from the vicinity of the journal bearing 39 and the thrust bearing 40 into the cavity 83 and is retained therein by the combination of the spacer ring 81, the seal ring 80 and the retaining ring 79. Because of the rotation of the collar 49 within the cavity 83 the oil within the cavity is circumferentially circulated to the opening 100, which is in the 2 o'clock position. The oil passes out of the opening 100 into the annular cavity 101, between the spacer ring 81 and the passage 84, and then passes through the passage 84 and into the oil sump 44.

While the present invention has been disclosed with particular reference to three particular embodiments, concepts of this invention are readily adapted to other embodiments, and those skilled in the art may vary the structure thereof with departing from the essential spirit of the present invention.

What is claimed is:

1. A method of reducing mechanical losses in a centrifugal compressor of the type having a bearing supported shaft connected to a gear, with the bearing being lubricated, comprising the steps of;

providing a stationary barrier around one end of the bearing to prevent oil from being slung out onto the gear; and providing an oil drainage port in fluid communication with an internal portion of said barrier for draining off oil that accumulates within said barrier.

2. A method as set forth in claim 1 wherein said oil drainage port drains the oil to a sump within the compressor.

3. A method as set forth in claim 1 wherein said shaft is a low speed drive shaft and said gear is a low speed drive gear.

4. A method as set forth in claim 1 wherein said shaft is a high speed driven shaft and said gear is a high speed driven gear.

5. A method as set forth in claim 4 wherein said bearing is a thrust bearing.

6. A method as set forth in claim 4 wherein said bearing is a journal bearing.

7. A method as set forth in claim 1 wherein said barrier comprises an annulus disposed between the bearing and the gear.

8. In a centrifugal compressor of the type having a shaft supporting bearing adjacent to a gear drivingly connected to the shaft, containment means for restraining the flow of oil from the bearing to the gear, comprising;

an annular ring having an L-shaped cross section comprised of an axial leg and a radial leg; and mounting means for locating said annular ring in a stationary position adjacent the bearing, such that one of said legs is in overlapping relationship with an axial or radial portion of the bearing to thereby restrain the flow of oil from the bearing to the gear.

9. A centrifugal compressor as set forth in claim 8 and including an oil port for draining off oil that accumulates within said annular ring.

10. A centrifugal compressor as set forth in claim 9 wherein said port drains the oil to a sump within the compressor.

11. A centrifugal compressor as set forth in claim 8 and including a seal ring that is held in place by said annular ring, said seal ring surrounding and engaging the outer circumference of the shaft to provide a sealing relationship therewith.

* * * * *